US010856372B2

(12) United States Patent
Schneider et al.

(10) Patent No.: US 10,856,372 B2
(45) Date of Patent: Dec. 1, 2020

(54) MEDICAL PREPARATION CONTAINER COMPRISING MICROWAVE POWERED SENSOR ASSEMBLY

(71) Applicant: DANMARKS TEKNISKE UNIVERSITET, Kgs. Lyngby (DK)

(72) Inventors: Henrik Schneider, Tune (DK); Kristian Lindberg-Poulsen, Copenhagen (DK)

(73) Assignee: DANMARKS TEKNISKE UNIVERSITET, Lyngby (DK)

( * ) Notice: Subject to any disclaimer, the term of this patent is extended or adjusted under 35 U.S.C. 154(b) by 0 days.

(21) Appl. No.: 15/565,247

(22) PCT Filed: Apr. 8, 2016

(86) PCT No.: PCT/EP2016/057791
§ 371 (c)(1),
(2) Date: Oct. 9, 2017

(87) PCT Pub. No.: WO2016/162499
PCT Pub. Date: Oct. 13, 2016

(65) Prior Publication Data

US 2018/0077763 A1 Mar. 15, 2018

(30) Foreign Application Priority Data

Apr. 10, 2015 (EP) ..... 15163201

(51) Int. Cl.
*H05B 6/68* (2006.01)
*H05B 6/64* (2006.01)
(Continued)

(52) U.S. Cl.
CPC ..... *H05B 6/6455* (2013.01); *A61J 9/02* (2013.01); *H05B 6/6452* (2013.01);
(Continued)

(58) Field of Classification Search
CPC .... H05B 6/6452; H05B 6/6467; H05B 6/687; H05B 6/66; H05B 6/6455; H05B 6/686; H05B 6/664; A61J 9/02
(Continued)

(56) References Cited

U.S. PATENT DOCUMENTS 3,494,722 A * 2/1970 Gray ..... A61L 2/12 422/21
4,088,863 A 5/1978 Jellies
(Continued)

FOREIGN PATENT DOCUMENTS

DE 202004003446 U1 * 8/2004 ..... F24C 7/08
EP 1757862 A2 2/2007
(Continued)

OTHER PUBLICATIONS

Pedreño-Molina et al., "Design and Validation of a Ten-Port Waveguide Reflectometer Sensor: Application to Efficiency Measurement and Optimization of Microwave Heating Ovens", Sensors 2008, 8, 7833-7849.
(Continued)

*Primary Examiner* — Quang T Van
(74) *Attorney, Agent, or Firm* — Lowenstein Sandler LLP

(57) ABSTRACT

The present invention relates to a medical preparation container which includes a microwave power sensor assembly. The microwave powered sensor assembly includes a sensor configured to measure a physical property or chemical property of a medical preparation during its heating in a microwave oven. The microwave powered sensor assembly is configured for harvesting energy from a microwave radiation emitted by the microwave oven and energize the sensor by the harvested microwave energy.

16 Claims, 7 Drawing Sheets

A)

B)

(51) Int. Cl.
*B01J 19/12* (2006.01)
*A61J 9/02* (2006.01)
*H05B 6/66* (2006.01)

(52) U.S. Cl.
CPC ..... *H05B 6/6467* (2013.01); *H05B 6/66* (2013.01); *H05B 6/686* (2013.01); *H05B 6/687* (2013.01); *H05B 6/664* (2013.01)

(58) Field of Classification Search
USPC ..... 219/713, 736, 756, 690, 691, 692, 693, 219/694, 695, 696, 697, 702, 728, 729, 219/730, 731, 746, 747, 748, 749, 750, 219/762; 331/66; 340/870.18, 870.39; 374/E1.004, E13.001; 99/329 R; 422/186, 119, 186.3, 186.29
See application file for complete search history.

(56) References Cited

U.S. PATENT DOCUMENTS

| | | | |
|---|---|---|---|
| 4,144,435 | A | 3/1979 | Clark et al. |
| 4,197,442 | A | 4/1980 | Carlsson et al. |
| 4,230,731 | A | 10/1980 | Tyler |
| 4,297,557 | A | 10/1981 | Tyler et al. |
| 4,377,733 | A | 3/1983 | Yamaguchi et al. |
| 4,467,163 | A | 8/1984 | Pauly et al. |
| 4,471,193 | A | 9/1984 | Walter |
| 4,590,348 | A | 5/1986 | Lahti et al. |
| 4,626,858 | A | 12/1986 | Copeland |
| 5,745,082 | A | 4/1998 | Alder |
| 6,208,903 | B1 | 3/2001 | Richards et al. |
| 6,844,535 | B2 | 1/2005 | Yang |
| 8,188,409 | B2 | 5/2012 | Baier |
| 2002/0157411 | A1 | 10/2002 | Ishikawa et al. |
| 2004/0051368 | A1 | 3/2004 | Caputo et al. |
| 2004/0056027 | A1 | 3/2004 | Miller |
| 2004/0238623 | A1 | 12/2004 | Asp |
| 2006/0022800 | A1 | 2/2006 | Krishna et al. |
| 2006/0207442 | A1 | 9/2006 | Pettersson |
| 2006/0213904 | A1 | 9/2006 | Kates |
| 2007/0210867 | A1* | 9/2007 | Bulkes ..... A61N 1/3787 330/251 |
| 2007/0229266 | A1 | 10/2007 | Gibson |
| 2007/0235448 | A1* | 10/2007 | Lihl ..... B01J 19/126 219/697 |
| 2008/0243088 | A1 | 10/2008 | Evans |
| 2009/0074631 | A1* | 3/2009 | Longo ..... B01J 3/048 422/186 |
| 2009/0315727 | A1 | 12/2009 | Goltenboth |
| 2010/0247403 | A1* | 9/2010 | Hancock ..... A61L 2/14 422/186.29 |
| 2010/0328037 | A1 | 12/2010 | Thomas et al. |
| 2012/0119971 | A1 | 5/2012 | Bae |
| 2013/0175262 | A1 | 7/2013 | Gharpurey et al. |
| 2015/0070029 | A1* | 3/2015 | Libman ..... H05B 6/686 324/637 |

FOREIGN PATENT DOCUMENTS

| | | | |
|---|---|---|---|
| GB | 2 119 127 | A | 11/1983 |
| JP | 52134461 | A | 11/1977 |
| JP | 04127059 | A | 4/1992 |
| JP | 2004-138331 | A | 5/2004 |
| JP | 2004222285 | A | 8/2004 |
| JP | 2006166522 | A | 6/2006 |

OTHER PUBLICATIONS

Sonmez et al., "MRI active guidewire with an embedded temperature probe and providing a distinct tip signal to enhance clinical safety", Journal of Cardiovascular Magnetic Resonance, 2012, 14:38.
Tinga, W. R., "Design Principles for Microwave Heating and Sintering", vol. 60, Symposium L—Defect Properties and Processing of High-Technology Nonmetallic Materials, 1985, 105.
Tsoli, A., "Sensor-based management systems based on RFID technology", Diploma Thesis, Jul. 2005.
Yam, K.L. et al, "Intelligent Packaging: Concepts and Applications", vol. 70, Nr. 1, 2005—Journal of Food Science R1 (Abstract).
Japanese Office Action dated May 19, 2020, on application No. 2018-503820.

* cited by examiner

A)

B)

A)

B)

MEDICAL PREPARATION CONTAINER COMPRISING MICROWAVE POWERED SENSOR ASSEMBLY

The present invention relates to a medical preparation container which comprises a microwave powered sensor assembly. The microwave powered sensor assembly comprises a sensor configured to measure a physical property or chemical property of a medical preparation during its heating in a microwave oven. The microwave powered sensor assembly is configured for harvesting energy from microwave radiation emitted by the microwave oven and energize the sensor by the harvested microwave energy.

BACKGROUND OF THE INVENTION

It is of great importance to monitor physical and/or chemical properties of medical preparations, such as intravenous infusion fluids, during heating processes for example in connection with a subsequent administration of the heated preparation to a patient. The medical preparation may be held in a suitable type of medical preparation container such as a plastic bag in connection with its heating.

It is for example important to accurately control the temperature of various types of intravenous infusion fluids during heating in an oven, a water bath or other heating device to avoid inactivating pharmaceutical compositions or active agents of the medical preparation by overheating and to avoid harming the intended recipient/patient in connection with administration of the medical preparation.

One aspect the present invention relates to a medical preparation container for holding a medical preparation. The medical preparation container comprises a microwave powered sensor assembly which comprises a sensor configured to measure a physical property and/or chemical property of the medical preparation during its heating. The microwave powered sensor assembly is configured for harvesting energy from microwave radiation emitted by a microwave oven and energizing the sensor, and possibly other circuits of the sensor assembly, by the harvested microwave energy. Hence, the desired physical and/or chemical properties of the medical preparation may be monitored or measured during heating of the medical preparation in the microwave oven.

US 2007/0229266 A1 discloses a prefilled syringe for holding contrast media. An RFID tag is integrated into a molded material plunger structure of the prefilled syringe. The prefilled syringe may be heated in a warming oven (36) arranged in a preparation room to raise the temperature of the contrast media to about body temperature. The RFID tag may store various types of data related to the use and lifetime of the prefilled syringe such as a unique container identification number, a security code that limits access to the RFID tag, a volume of the pharmaceutical held in the container, identity, or type, of the pharmaceutical in the container, manufacturing date, an expiration time and/or date etc.

SUMMARY OF THE INVENTION

A first aspect of the invention relates to a medical preparation container comprising a microwave powered sensor assembly. The microwave powered sensor assembly comprising:

a microwave antenna having a predetermined tuning frequency for generating an RF antenna signal in response to microwave radiation at a predetermined excitation frequency, a dc power supply circuit coupled to the RF antenna signal and configured to produce a power supply voltage by rectifying and extracting energy from the RF antenna signal, a sensor connected to the power supply voltage and configured to measure a physical property or a chemical property of a medical preparation held in the medical preparation container.

The medical preparation container may comprise various types of suitable container for example at least one of: a medical fluid bag, an agar container, a syringe.

The sensor may be in physical contact with the medical preparation to measure or detect a physical property of the medical preparation such as a temperature, viscosity, pressure, colour, humidity, reflectivity, electric conductivity etc. The sensor may be arranged to measure the physical or chemical property, for example temperature, at a core of the medical preparation in question. Alternatively, the sensor may be arranged to measure the physical or chemical property at a surface of the medical preparation for example by contact to an outer surface of the medical preparation.

Some embodiments of the sensor may operate without physical contact to the medical preparation and instead remotely sense/measure the physical property of the medical preparation e.g. using an infrared (IR) temperature detector etc. The sensory portion of the sensor may alternatively or additionally measure or detect a chemical property of the medical preparation for example water content or the presence and/or concentration of certain active agents in the medical preparation. The microwave powered sensor assembly may comprise multiple individual sensors of different types or comprise multiple individual sensors of the same type. Multiple individual sensors of different types may be configured to measure different physical properties and/or chemical properties of the medical preparation while multiple sensors of the same type may be configured to measure the physical or chemical property in question, for example temperature, at different locations of the medical preparation for example simultaneously at the core and at the surface. Hence, the sensor may be arranged to obtain physical contact or sensory contact with the medical preparation using various techniques such as direct physical contact or indirect contact through a layer of the medical preparation container as discussed in additional detail below with reference to the appended drawings. The microwave powered sensor assembly may be partially or fully embedded in a wall section, lid section, or bottom section of the medical container. This will typically fasten the microwave powered sensor assembly to the medical preparation container in a permanent manner. In the alternative, the microwave powered sensor assembly may be detachably fastened to the medical container for example to a wall section, a lid section or bottom section of the medical container for example by a glue agent or elastic band etc.

The present medical preparation container may be inserted in the oven chamber of various types of commercially available microwave ovens and the medical preparation heated in a rapid and efficient manner. The sensor may comprise a temperature sensor such that the temperature of the medical preparation can be monitored and controlled either automatically or manually by a medical professional such as a doctor or nurse. Since microwave ovens are well-known and highly popular kitchen appliances, they are readily available in numerous configurations and dimensions at a low cost. The microwave oven heats the medical preparation by electromagnetic irradiation in the microwave spectrum causing dielectric heating as well as causing polarized molecules in the preparation to rotate and build up thermal energy.

Parameter values of the measured physical and/or chemical property or properties of the medical preparation may be transmitted wirelessly to the outside of the microwave oven chamber during heating of the medical preparation. Alternatively, the parameter values of the measured physical or chemical property or properties of the medical preparation may be displayed on a suitable parameter indicator such as a display connected to, or integrated, with the medical preparation container. The parameter indicator may comprise at least one indicator selected from a group of {a LED, multiple LEDs of different color, a loudspeaker, an alphanumeric display, E-ink paper}. The functionality and technical details of the parameter indicator is discussed in further detail below with reference to the appended drawings. However, the use of E-ink paper as parameter indicator is particularly attractive in some applications because E-ink paper allows the measured parameter value or values to be inspected by the user after the microwave oven is turned off and the energy source interrupted due to the bi-stable operation of E-ink paper.

The ability of the microwave powered sensor assembly to be energized by the harvested microwave energy entails numerous advantages such as elimination of batteries. Due to the extremely EMI hostile environment inside the oven compartment it may be unsafe to place batteries or similar chemical energy storage device for powering the assembly inside the oven chamber. Furthermore, the need for battery replacement in the sensor assembly would make it difficult to make a housing of a battery powered sensor assembly hermetically sealed against the external environment. The sensor may comprise a temperature sensor for example a thermistor.

However, the strength of the microwave electromagnetic radiation or microwave field inside the microwave oven is often excessive and may irreversibly damage various active or passive components of the dc (DC) power supply circuit, or other electronic circuitry, of the microwave powered active sensor assembly. The component damage may be caused by RF signal voltages, delivered by an RF antenna of the microwave powered sensor assembly in response to the RF electromagnetic radiation, which exceeds a maximum voltage rating and/or maximum power rating of the active or passive components of the dc power supply circuit. Such damaging RF signal voltages may lead to the destruction of the active or passive components of the DC power supply circuit. This is particularly the case where the DC power supply circuit, and possibly additional electronic circuitry, is integrated on a sub-micron CMOS semiconductor substrate which imposes severe restrictions on the voltage level and/or power level that can be tolerated without overheating or break-down of the active or passive components formed in the semiconductor substrate.

Hence, it would be advantageous to be able to limit the amount of power harvested by the RF antenna and supplied to the DC power supply circuit of the microwave powered active sensor assembly for example when exposed to excessive levels of microwave energy inside the microwave oven. This is accomplished in accordance with one embodiment of the medical preparation container wherein the microwave powered sensor assembly further comprises an RF power limiter connected in-between the RF antenna signal and the dc power supply circuit for limiting an amplitude or power of the RF antenna signal in accordance with predetermined signal limiting characteristics.

It may be impossible, or at least highly impractical, to absorb or dissipate large amounts of RF power in components of a small CMOS semiconductor substrate in certain applications of the microwave powered sensor assembly. Hence, it would further be advantageous to prevent too much energy entering the semiconductor substrate. This is accomplished in accordance with an embodiment of the RF power limiter which comprises:

a variable impedance circuit connected across the RF antenna signal, for example across a pair of RF antenna terminals;

wherein said variable impedance circuit exhibits a decreasing input impedance with increasing amplitude or power of the RF antenna signal at the predetermined excitation frequency to decrease a matching between the input impedance of the power limiter and an impedance of the microwave antenna.

The variable impedance circuit may be configured to exhibit a substantially constant input impedance at power or amplitude levels of the RF antenna signal below a threshold level; and exhibit a gradually, or abruptly, decreasing input impedance at power or amplitude levels of the RF antenna signal above the threshold level. The input impedance of the variable impedance circuit may for example gradually decrease with increasing input power of the RF antenna signal above the threshold level.

The variable impedance circuit may comprise a PIN limiter diode or a controlled FET transistor as discussed in further detail below with reference to the appended drawings. The DC power supply circuit may comprise one or more RF Schottky diode(s) for rectification of the limited RF antenna signal for the reasons discussed in further detail below with reference to the appended drawings.

The microwave antenna may comprise various antenna designs for example at least one of: {a monopole antenna, a dipole antenna, a patch antenna}. The microwave antenna may be integrally formed in a wire or conductor pattern of a carrier or substrate, such as a printed circuit board, supporting the microwave powered sensor assembly. A monopole microwave antenna is generally compact and omni-directional.

One embodiment of the microwave powered sensor assembly is configured for industrial types of microwave ovens using the standardized 915 MHz frequency of emitted microwave radiation. An alternative embodiment of the microwave powered sensor assembly is configured for consumer types of microwave ovens using the standardized 2.45 GHz frequency of emitted microwave radiation. The tuning frequency and possibly physical dimensions of the microwave antenna may for example differ between these types of microwave powered sensor assemblies. In either case, the microwave antenna is responsive to the excitation created by the microwave radiation in the oven chamber of the industrial or consumer variant of microwave oven during heating of the medical preparation in the oven chamber. The microwave antenna generates the RF antenna signal and the DC power supply circuit rectifies and extracts energy from either the limited RF antenna signal or directly from the received RF antenna signal. The power supply voltage generated by the DC power supply circuit may be connected to active electronic circuits and components of the microwave powered sensor assembly and supply electrical power thereto. The active electronic circuits and components may in addition to the sensor comprise a digital processor, a display, a wireless data transmitter etc. Hence, the microwave powered sensor assembly is able to operate without any battery source by instead relying on energy harvested from the microwave radiation in the oven chamber.

The microwave antenna may be detuned with a predetermined frequency amount from the expected excitation frequency, e.g. either 2.45 GHz or 915 MHz, of the microwave radiation used to energize the particular embodiment of the microwave powered sensor assembly. The predetermined tuning frequency of the microwave antenna may for example deviate from the predetermined excitation frequency (915 MHz or 2.45 GHz) of the microwave radiation by more than +50% or more than −33% such as at least +100% or at least −50%. The detuning decreases the amount of microwave energy picked-up by the microwave antenna and therefore decreases the level of the RF antenna signal applied to either the RF power limiter (if present) and to the dc power supply circuit and may assist in protecting the latter circuits against excessive voltage and power levels of the RF antenna signal when the microwave antenna is situated in a hot spot in the oven chamber.

A higher tuning frequency of the microwave antenna than the standardized 2.45 GHz (or 915 MHz) microwave radiation frequency leads to the additional benefit of smaller physical dimensions of the microwave antenna. The smaller physical dimensions leads to various benefits as discussed in further detail below with reference to the appended drawings.

In one embodiment of the invention a generator impedance of the microwave antenna is at least two times larger than an input impedance at the RF power limiter at the predetermined excitation frequency of the microwave radiation.

The microwave powered sensor assembly may be enclosed by a housing. Hence, one embodiment of the microwave powered sensor assembly comprises:

an electrically conductive housing, such as a metal sheet or metal net, enclosing and shielding at least the power supply circuit against the microwave electromagnetic radiation. The microwave antenna is preferably arranged outside the housing if the latter comprises an electrically conducting material to allow the microwave radiation to reach the microwave antenna substantially without significant attenuation and thereby harvest microwave energy. The electrically conductive housing may comprise a metal sheet or metal net, enclosing and shielding at least the RF power limiter and the power supply circuit against the microwave electromagnetic radiation.

The housing may be hermetically sealed to protect these circuits and sensor enclosed therein against harmful liquids, gasses or other contaminants of the medical preparation present within the oven chamber. A sensory portion of the sensor may protrude from the housing to allow the sensory portion to obtain physical contact with the medical preparation.

The microwave powered sensor assembly may comprise a digital processor coupled to the power supply voltage for receipt of operating power and a wireless data transmitter for transmission, to the exterior of the oven chamber, of parameter values of the measured physical or chemical property of the medical preparation. The wireless data transmitter may be configured to transmit the wireless data signal repeatedly at regular time intervals or at irregular time intervals during heating of the medical preparation depending on the needs of a particular application. The wireless data transmitter may comprise an optical data transmitter. The wireless data transmitter may be coupled to the digital processor, or possibly directly to the sensor, for receipt and wireless transmission of the measured parameter values of the physical or chemical property or properties of the medical preparation to the exterior of the oven chamber. The wireless data transmitter may be configured to emit a wireless data signal comprising the measured parameter values encoded in digital format. The wireless data signal may be transmitted to a suitable wireless receiver arranged at the outside of the oven chamber as discussed in further detail below with reference to the appended drawings. The skilled person will understand that there are certain advantages of using optical data transmitters and optical data signals as these are entirely immune to the previously discussed excessive levels of microwave radiation inside the oven chamber. Furthermore, microwave ovens tend to act essentially as a Faraday cage to block any emission of microwave signals, including RF data signals, to avoid leakage of the potentially harmful microwave radiation to the outside and reach the users.

One embodiment of the microwave powered sensor assembly comprises a data memory, such as a non-volatile memory like a flash memory or EEPROM, for storage of a target temperature profile for heating of the medical preparation. The digital processor may be configured to read the target temperature profile from the data memory and transmit the target temperature profile via the wireless data transmitter to the exterior of the oven chamber. Various features and advantages of this embodiment of the microwave powered sensor assembly are discussed in further detail below with reference to the appended drawings.

A second aspect of the invention relates to a method of monitoring a physical or chemical property of a medical preparation during heating, said method comprising steps of:

a) positioning a medical preparation container, holding a medical preparation, according to any of the previous claims inside an oven chamber of a microwave oven,
b) activating the microwave oven to produce electromagnetic radiation within the oven chamber thereby irradiating and heating the medical preparation,
c) extracting energy from the RF antenna signal in response to irradiation of the microwave powered sensor assembly by the electromagnetic radiation,
d) repeatedly measuring the physical property or the chemical property of the medical preparation by the sensor.

The method of monitoring physical or chemical properties of the medical preparation according may comprise at least one additional step of:

displaying a parameter value of the measured physical or chemical property of the medical preparation; and
transmitting a parameter value of the physical or chemical property of the medical preparation to a wireless receiver arranged outside the oven chamber via a wireless data communication link.

The wireless data communication link may be utilized by the above discussed wireless data transmitter to establishing an wireless, e.g. optical, data transmission channel to the previously discussed optical receiver arranged at the outside of the oven chamber. The optical data transmitter may be emitting the optical data signal as light waves in the visible spectrum or in the infrared spectrum.

The method of monitoring the physical or chemical properties of a medical preparation may comprise limiting an amplitude or a power of the RF antenna signal in accordance with predetermined signal limiting characteristics of an RF power limiter for the reasons discussed above. The signal limiting characteristics may be carried out by peak-clipping of the signal waveform of the RF antenna signal or by an Automatic Gain Control (AGC) function without distorting the signal waveform of the RF antenna signal.

BRIEF DESCRIPTION OF THE DRAWINGS

Preferred embodiments of the invention will be described in more detail in connection with the appended drawings, in which.

DETAILED DESCRIPTION OF PREFERRED EMBODIMENTS

Figure 1:
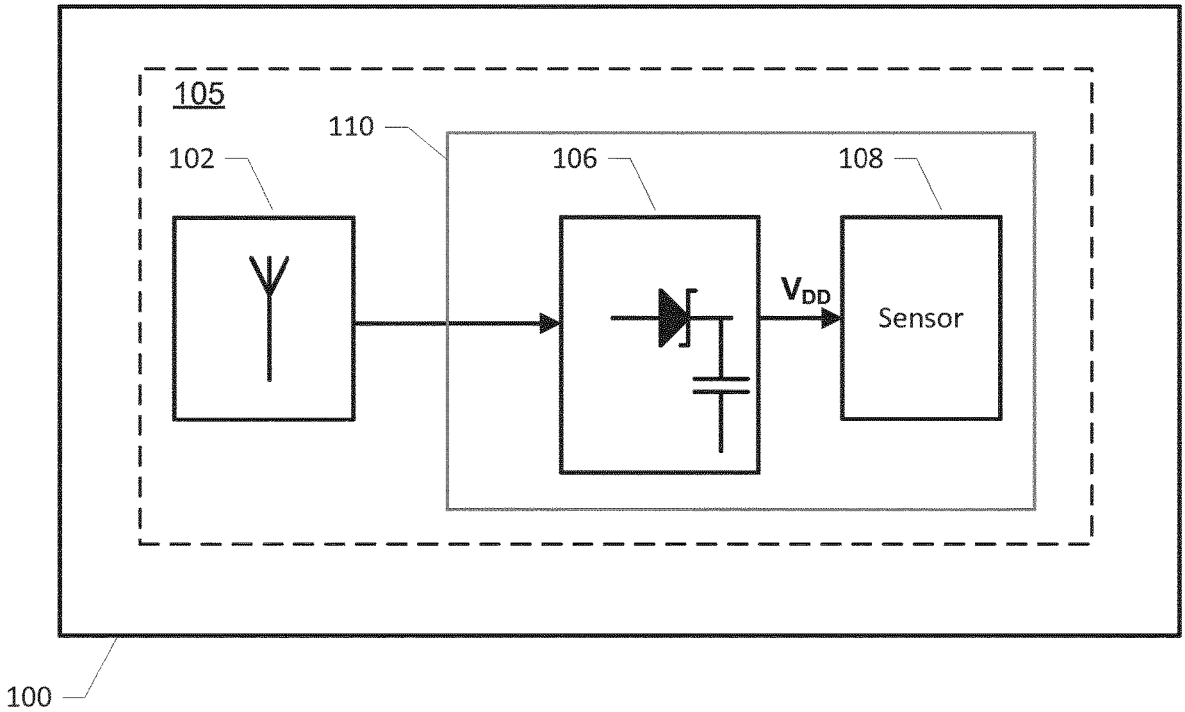
FIG. 1A) shows a simplified schematic block diagram of a medical preparation container comprising a microwave powered sensor assembly in accordance with a first embodiment of the invention, FIG. 1B) shows a simplified schematic block diagram of a medical preparation container comprising a microwave powered sensor assembly in accordance with a second embodiment of the invention.
Figure 1:
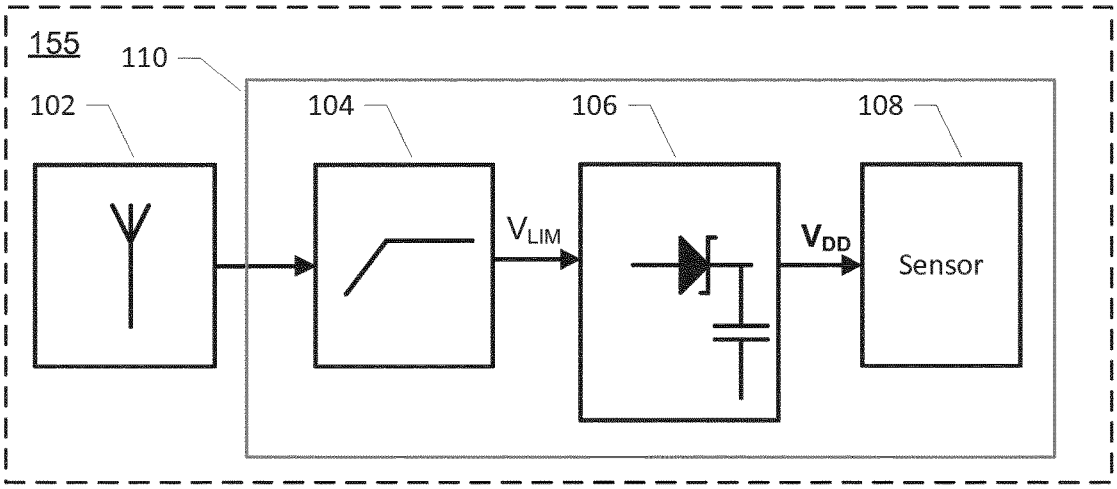

FIG. 1A) shows a simplified schematic block diagram of a medical preparation container 100 comprising a microwave powered sensor assembly 105 in accordance with a first embodiment of the invention. The medical preparation container 100 may comprise an infusion fluid bag as illustrated on FIG. 5 or a syringe or an agar container. The medical preparation container 100 is suitable for use in various types of industrial or consumer microwave ovens (not shown). The microwave powered sensor assembly 105 may be partially or fully embedded in a material of the medical preparation container such as a wall section, lid section, or bottom section as discussed below in additional detail with reference to FIGS. 6 and 7.

The microwave powered sensor assembly 105 comprises a microwave antenna 102 with a tuning frequency in the microwave region or frequency range—for example a tuning frequency between 800 MHz and 3.0 GHz. The microwave antenna 102 is responsive to excitation by the microwave radiation or electromagnetic field generated in an oven chamber of the industrial or consumer type of microwave oven in question during heating of the medical preparation held in the medical preparation container 100. The medical preparation container 100 may be positioned or inserted into the oven chamber by a medical professional and the microwave oven activated thereafter. The skilled person will understand that the microwave antenna 102 may be dimensioned or designed with a tuning frequency of about 2.45 GHz if the medical preparation container 100 is intended for use in consumer type of microwave ovens. The microwave antenna 102 may be dimensioned or designed with a tuning frequency of about 915 MHz if the medical preparation container 100 is intended for use in industrial type of microwave ovens. The tuning frequency of the microwave antenna 102 may alternatively be detuned with a predetermined amount from the expected excitation frequency, either 2.45 GHz or 915 MHz, of the microwave radiation as discussed above.

A sensory portion of a sensor 108 of the microwave powered sensor assembly 105 may be in physical contact with the medical preparation to measure or detect a physical property of the medical preparation during heating such as a temperature, viscosity, pressure, colour, humidity, electric conductivity etc. In the alternative, the sensor 108 may operate without physical contact to the medical preparation and instead measure the physical property of the medical preparation by remote or non-contact sensing, e.g. using an infrared (IR) temperature detector etc. The sensory portion of the sensor 108 may alternatively measure or detect a chemical property of the medical preparation under heating for example its water content, its pH level or the presence and/or concentration of certain chemical agents such as salt, sugar, acids, fats etc. in the medical preparation.

The skilled person will understand that the sensor 108 may be configured to measure or detect several different physical properties of the medical preparation and/or one or more chemical properties. The microwave powered sensor assembly 105 may comprise multiple individual sensors of different types to measure the different physical properties and/or chemical properties of the medical preparation.

The microwave antenna 102 is responsive to the excitation by the microwave radiation as mentioned above to generate a RF (radio frequency) antenna signal which is connected to an input of a dc (DC) power supply circuit 106 of the microwave powered sensor assembly 100 either directly or through an optional RF power limiter 104 as discussed below. The DC power supply circuit 106 is configured to rectify the received RF antenna signal and extract a DC power supply voltage $V_{DD}$ therefrom. The DC power supply circuit 106 may comprise one or more filter or smoothing capacitor(s) coupled to the output of a rectifying element. Several types of rectifying elements may be used such as semiconductor diodes or actively controlled semiconductor switches/transistors. In one embodiment, the rectifying element comprises a Schottky diode as schematically indicated on circuit block 106. The one or more filter or smoothing capacitor(s) serves to suppress voltage ripple and noise on the DC supply voltage $V_{DD}$ and may further serve as an energy reservoir. The energy reservoir stores extracted energy for a certain time period and ensures that the DC power supply voltage remains charged or powered during short drop outs of the RF antenna signal as discussed below in additional detail. The sensor 108 is powered or energized by the DC supply voltage $V_{DD}$ for example via a power supply terminal or input of the sensor 108 connected to $V_{DD}$. The sensor 108 may comprise various types of active digital and/or analog electronic circuitry and/or display components that need power to function properly.

The microwave powered sensor assembly 105 preferably comprises a housing or casing 110 surrounding and enclosing at least the DC power supply circuit 106 and sensor 108. The housing 110 may be hermetically sealed to protect these circuits and the sensor(s) enclosed therein against harmful liquids, gasses or other contaminants inside the oven chamber. The previously discussed sensory portion of the sensor 108 may protrude to the outside of the housing 110 and through the wall of the medical preparation container 100. This will allow the sensory portion to obtain physical contact with the medical preparation. The housing 110 may comprise an electrically conductive layer or shield, such as a metal sheet or metal net enclosing at least the power supply circuit 106 and the sensor 108, against the strong RF microwave electromagnetic field generated by the microwave oven during operation. The microwave or RF antenna 102 is preferably placed outside the electrically shielded housing 110 to allow unhindered harvesting of the microwave energy from the microwave radiation or field.

The measured or detected physical property and/or chemical property of the medical preparation may be indicated to a user of the microwave oven in numerous ways. In certain embodiments of the microwave powered sensor assembly 105, the latter comprises a display configured to displaying parameter values or respective parameter values of the measured physical and/or chemical properties of the medical preparation to the outside of the microwave oven as discussed in further detail below with reference to FIG. 3. In alternative embodiments of the microwave powered sensor assembly 105, the latter comprises a wireless data communication transmitter configured for transmitting the parameter values or respective parameter values of the measured physical and/or chemical properties of the medical preparation to the outside of the microwave oven chamber as discussed in further detail below with reference to FIG. 2.

FIG. 1B) shows a simplified schematic block diagram of a microwave powered sensor assembly 155 in accordance with a second embodiment of the invention for application to/integration within a medical preparation container such as the previously discussed container 100. The microwave powered sensor assembly 155 comprises an RF power limiter 104 in addition to the previously described circuits and elements 102, 106, 108 and 110. The RF power limiter 104 is connected in-between the RF antenna signal at the RF antenna output and an input of the DC power supply circuit 106.

Hence, the RF antenna signal is electrically coupled or connected to an input of the RF power limiter 104 instead of directly to the DC power supply circuit 106 as in the first embodiment of the microwave powered sensor assembly. The RF power limiter 104 is configured to limiting a level such as amplitude level, power level or energy level of the RF antenna signal in accordance with signal limiting characteristics of the RF power limiter 104. The RF power limiter 104 produces a limited RF antenna signal $V_{LIM}$ at a limiter output in response to the RF antenna signal. The signal limiting characteristics may for example comprise a linear behaviour at relatively small levels of the RF antenna signal, for example below a certain threshold level, and a non-linear behaviour above the threshold level. In this manner, the level of the RF antenna signal and the level of the limited RF antenna signal may be largely identical for RF antenna signals below the threshold level while the level of the limited RF antenna signal may be smaller than the level of the RF antenna signal above the threshold level. Various circuit details and mechanisms to produce different types of signal limiting characteristics of the optional RF power limiter 104 are discussed below in additional detail.

The inclusion of the RF power limiter 104 has several advantages for example by protecting the down-stream DC power supply circuit 106, electrically coupled to the limited RF antenna signal, against overvoltage conditions created by excessively large power levels or amplitude levels of the RF antenna signal in response to the RF electromagnetic radiation in the oven chamber. These excessive signal input conditions are quite contrary to the operation of normal wireless RF data communication equipment where the challenge often is to obtain sufficient RF power to safely transmit or decode data signals modulated onto the carrier wave. In contrast, the microwave powered sensor assembly 155 will often be placed very close to the source of the RF electromagnetic radiation in the oven chamber leading to excessively large voltages and input power of the RF antenna signal. Furthermore, the strength of the microwave radiation in the oven chamber is often highly variable through the chamber due to standing waves. These standing waves lead to the formation of so-called "hot spots" and "cold spots" inside the oven chamber during operation with highly different field strengths of the microwave radiation. The microwave powered sensor assembly 155 should be configured to at one hand extract sufficient power from the microwave antenna to ensure proper operation when positioned in a cold spot and on the other hand be able to withstand very large amplitude RF antenna signals when the microwave antenna is positioned in a hot spot. In the latter situation, the RF power limiter 104 ensures that these large amplitude RF antenna signals are attenuated by reflecting a large portion of the incoming RF signal power back to the microwave antenna for emission as discussed in further detail below.

Figure 2:
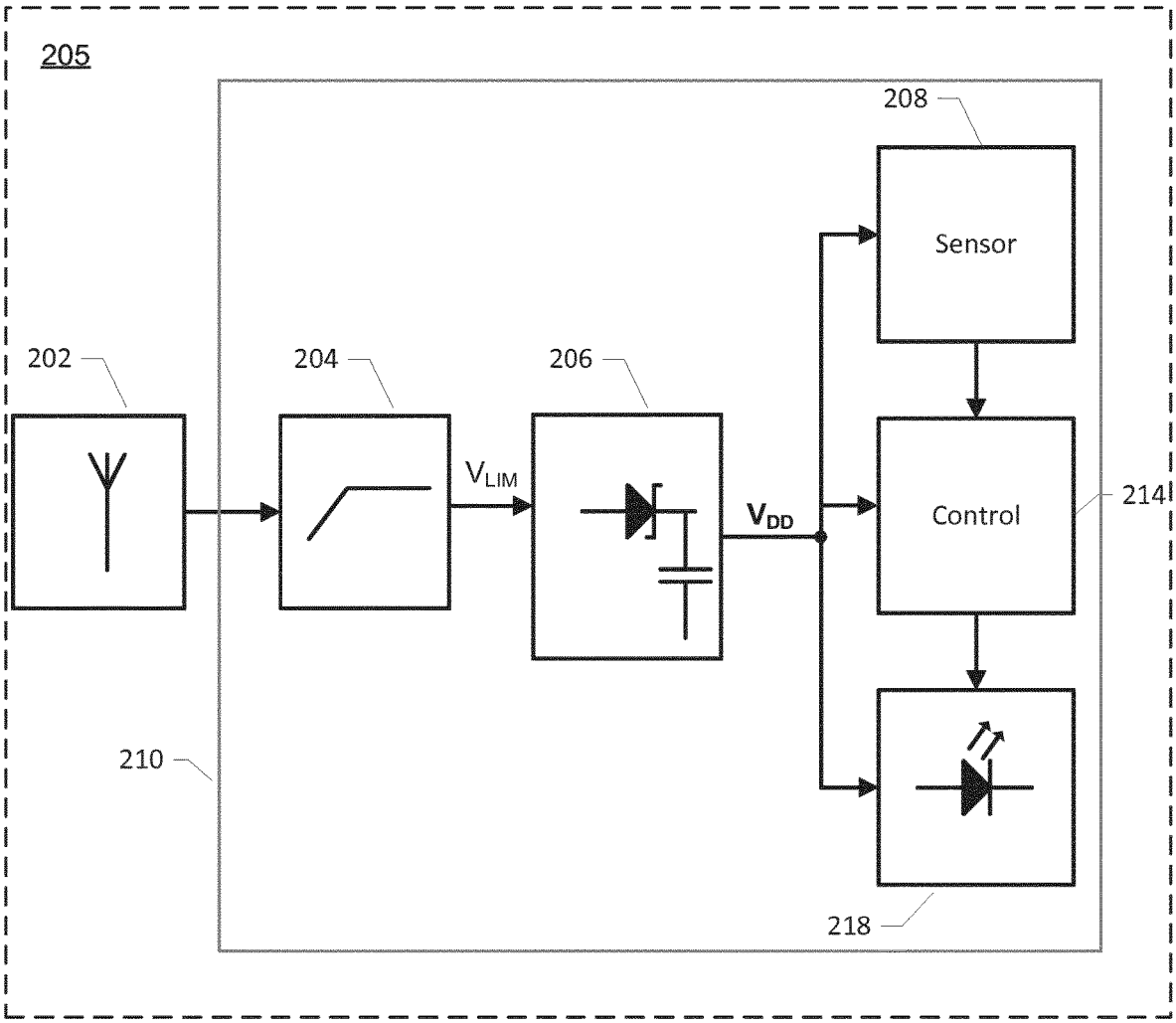
FIG. 2 shows a simplified schematic block diagram of a microwave powered sensor assembly in accordance with a third embodiment of the invention for use in medical preparation containers.

FIG. 2 shows a simplified schematic block diagram of a microwave powered sensor assembly 205 in accordance with a third embodiment of the invention for application to/integration within a medical preparation container such as the previously discussed container 100. Corresponding elements and features of the first and third embodiments of the microwave powered sensor assembly have been assigned corresponding reference numerals to ease comparison. The microwave powered sensor assembly 200 comprises a microwave antenna 202 which may have identical characteristics to those of the microwave antenna 102 discussed above. An RF antenna signal is electrically coupled to the input of an optional RF power limiter 204 which may possess identical characteristics to those of the RF power limiter 104 discussed above. The output of the RF power limiter 204 is coupled to a DC power supply circuit 206 configured to rectify a limited RF antenna signal $V_{LIM}$ and extract a DC power supply voltage $V_{DD}$ therefrom as discussed above in connection with the first and second embodiments of the microwave powered sensor assembly. The DC power supply voltage $V_{DD}$ energizes or powers a sensor 208, a controller 214 such as a digital processor and an optical data transmitter 218. The DC power supply voltage $V_{DD}$ may be coupled or connected to respective power supply terminals or inputs of the sensor 208, controller 214 and optical data transmitter 218.

Hence, these latter circuits are connected to the DC power supply voltage $V_{DD}$ for receipt of operating power. The sensor 208 may comprise various types of active digital and/or analog electronic circuitry and/or display components that need power to function properly. The digital processor 214 may comprise a hard-wired digital processor configured to perform various predetermined control functions of the microwave powered sensor assembly 200. In the alternative, the digital processor 214 may comprise a software programmable microprocessor adapted to perform the control functions of the microwave powered sensor assembly 200 in accordance with a set of executable program instructions stored in program memory of the software programmable microprocessor. The digital processor 214 may comprise an input port connected to the sensor 208 for receipt of measured parameter values of the previously discussed physical or chemical properties in question of the medical preparation. A sensory portion of the sensor 208 may be in physical or sensory contact with the medical preparation to measure or detect the physical property of the medical preparation during heating/preparation such as a temperature, viscosity, pressure, colour, humidity, electric conductivity etc. The skilled person will understand that the measured parameter values may be outputted by the sensor 208 in analog format or in digital format depending on the characteristics of the sensor 208 and any signal conditioning circuitry integrated with the sensor. If the parameter values are outputted in digital format, the input port of the digital processor 214 may comprise an ordinary I/O port or an industry standard data communication port such as I2C or SPI. If the parameter values are outputted by the sensor 208 in analog format, the input port of the digital processor 214 may comprise an analog input connected to an internal A/D converter to convert the received parameter values to a digital format and create a corresponding data stream or data signal comprising the measured parameter values. The optical data transmitter 218 is coupled to a data port of the digital processor 214 supplying the measured parameter values encoded in a predetermined data format to the optical data transmitter 218 for optical modulation and transmission to a suitable optical receiver (not shown) arranged at the outside of the oven chamber. The optical data transmitter 218 may comprise a modulated LED diode emitting the optical data signal by waves in the visible spectrum or in the infrared spectrum. The optical receiver may comprise a photodetector such as a LED. The digital processor 214 and optical data transmitter 218 may be configured to transmit the optical data signal continuously, at regular time intervals or at irregular time intervals during heating of the medical preparation depending on the particular application. The microwave powered sensor assembly 200 preferably comprises a housing or casing 210 surrounding and enclosing at least the RF power limiter 204, dc power supply circuit 206, digital processor 214, sensor 208 and optical data transmitter 218. The housing 210 may possess the same properties as the housing 110 discussed above.

The microwave oven may comprise a glass lid with an inner surface covered by a metallic net or grid which functions as an EMI shield of the oven to prevent leakage of the microwave radiation emitted by the oven during operation to the external environment outside the oven chamber. The photodetector may be attached directly on an outer surface of the glass lid of the microwave oven such that the optical data signal is transmitted through the glass lid to the photodetector. The photodetector may be placed in an opening of the EMI shield allowing the optical waves carrying the optical data signal unhindered propagation to the photodetector. The photodetector may be electrically or wirelessly coupled to a microprocessor of the microwave oven and transmit the received optical data signal, comprising the measured parameter values, to the controller of the microwave oven. The microprocessor of the microwave oven may be configured to use the received parameter values to automatically control the operation of the microwave oven. In one embodiment, the measured parameter values of the medical preparation may comprise current temperatures of the medical preparation and the microprocessor of the microwave oven may be configured to terminate the heating when the current temperature of the medical preparation reaches a certain target temperature.

Another embodiment of the microwave powered sensor assembly 200 additionally comprises a data memory, for example a non-volatile memory such as flash memory, for storage of a target temperature profile for heating of the medical preparation. The digital processor 214 is configured to read the target temperature profile from the data memory and transmit the target temperature profile via the optical data transmitter 218, or another suitable wireless data transmitter, to the exterior of the oven chamber. The target temperature profile may for example be transmitted to the previously discussed photodetector attached to the outer surface of the glass lid of the microwave oven and therefrom to the microprocessor of the microwave oven.

The temperature profile may specify a sequence of target temperatures over time for the heating of the medical preparation. In certain embodiments, the target temperature profile may be formed by a single temperature value for example a stop or termination temperature of the medical preparation. Hence, the control program of the microwave oven may initially receive and record this stop or termination temperature and thereafter monitoring incoming temperature values as repeatedly transmitted by the microwave powered sensor assembly 205 during heating of the medical preparation. In response to the measured temperature of the medical preparation reaches the stored termination temperature, the control program may terminate the heating of the microwave oven, or possibly markedly reducing the amount of emitted microwave energy in the oven chamber to avoid overheating the medical preparation. Hence, the microwave powered sensor assembly and the microwave oven jointly form an "intelligent" cooperating microwave heating system.

Figure 3:
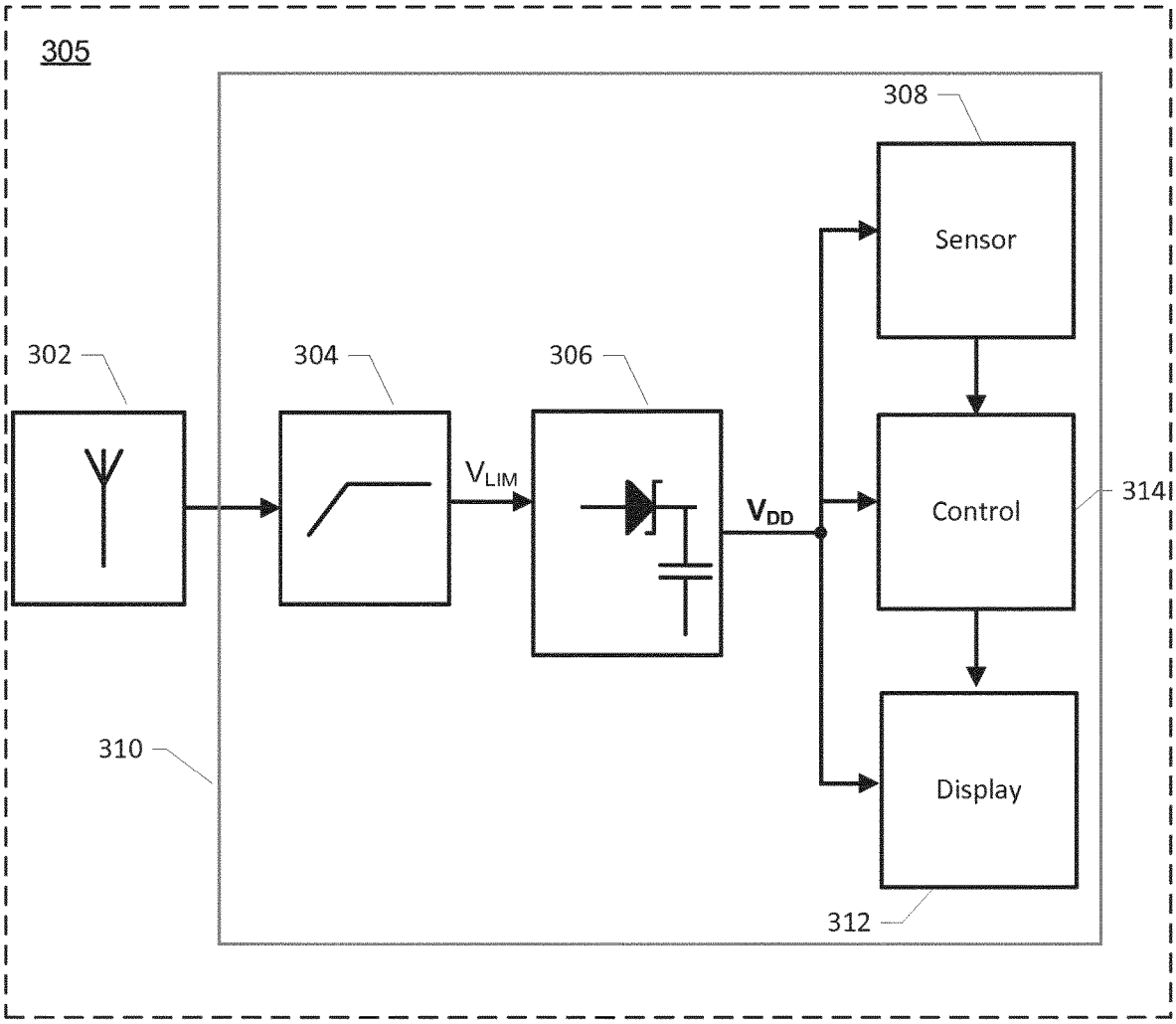
FIG. 3 is a simplified schematic block diagram of a microwave powered sensor assembly for application in various types of medical preparation containers in accordance with a fourth embodiment of the invention, FIG. 4A) shows a simplified electrical circuit diagram of a first exemplary RF power limiter and DC power supply circuit of the microwave powered sensor assemblies in accordance with various embodiments of the invention, FIG. 4B) shows a simplified electrical circuit diagram of a second exemplary RF power limiter and DC power supply circuit of the microwave powered sensor assemblies in accordance with various embodiments of the invention.

FIG. 3 shows a simplified schematic block diagram of a microwave powered sensor assembly 305 in accordance with a fourth embodiment of the invention for application to/integration within a medical preparation container such as the previously discussed container 100. Corresponding elements and features of the third and fourth embodiments of the microwave powered sensor assembly have been assigned corresponding reference numerals to ease comparison. The main difference between the present microwave powered sensor assembly 305 and the previously discussed microwave powered sensor assembly 205 is that the optical data transmitter 218 of the latter has been replaced by a display 312. The display 312 functions as a parameter indicator for displaying the measured parameter values of the physical or chemical property of the medical preparation to the exterior of the oven chamber. The display 312 is also powered by a dc power supply voltage $V_{DD}$ generated by a DC power supply circuit 306 of the microwave powered sensor assembly 300. The skilled person will understand that the illustrated RF power limiter 304 is an optional circuit and other embodiments may couple the RF antenna signal generated by the RF antenna 302 directly to the DC power supply circuit 306. The display 312 functions as a parameter indicator for displaying parameter values of the monitored physical or chemical property or properties of the medical preparation of the medical preparation container to the exterior of the oven chamber (not shown). The display 312 is preferably configured to indicate the measured parameter values with sufficient size and/or brightness to allow a user to read a current parameter value through a glass door or lid of the oven during operation of the oven. The display 312 may comprise various types of parameter value indicators such as a LED, multiple LEDs of different color, a loudspeaker, an alphanumeric display and E-ink paper. The microwave powered sensor assembly 305 preferably comprises a housing or casing 310 surrounding and enclosing at least the RF power limiter 304, DC power supply circuit 306, digital processor 314, sensor 308 and display 312. The housing 210 may possess the same properties as the housing 110 discussed above.

Figure 4:
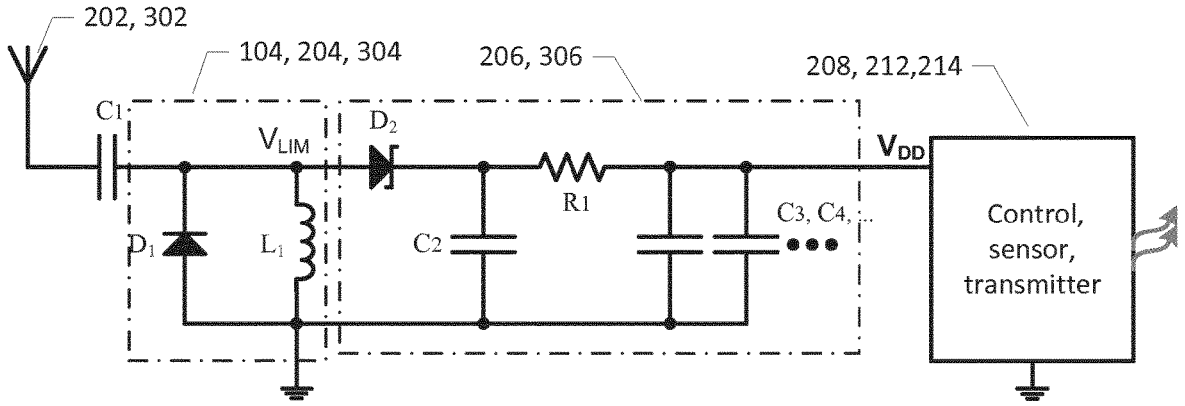
Figure 4:
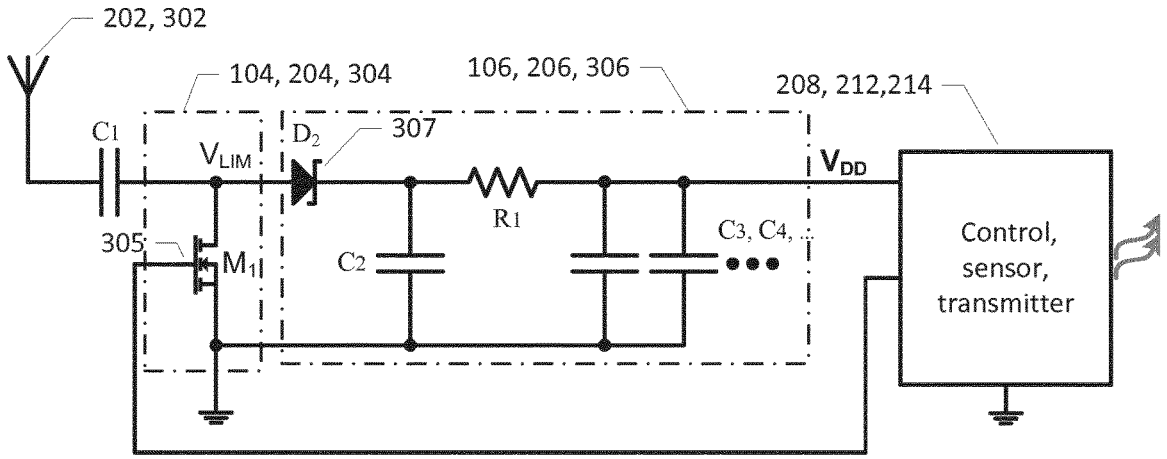

FIG. 4A) shows a simplified electrical circuit diagram of a first exemplary RF power limiter 104, 204, 304 and DC power supply circuit 106, 206, 306 suitable for use in the above discussed second, third and fourth embodiments of the present microwave powered sensor assembly 155, 205, 305. The RF power limiter comprises a PIN limiter diode and a parallel inductor L1. The PIN limiter diode D1 is coupled from the RF antenna signal to ground of the RF power limiter and presents a variable shunt impedance to the microwave antenna 102, 202, 302 where the shunt impedance varies with a level of the incoming RF antenna signal. The RF power limiter therefore generates a limited or attenuated RF antenna signal $V_{LIM}$ compared to the RF antenna signal produced at the output of the microwave antenna 102, 202, 302. The limited RF antenna signal $V_{LIM}$ is applied to the input of the DC power supply circuit 106, 206,306, in particular to a cathode of a rectifying element in form of Schottky diode $D_2$. The parallel inductor ensures proper DC biasing of the PIN limiter diode D1. The impedance of the PIN limiter diode is relatively large, for example larger than 1000 ohm, for small levels of the RF antenna signal and gradually decreases with increasing level of the RF antenna signal such that the input impedance of the RF power limiter behaves in a corresponding manner. In one exemplary embodiment, the generator impedance of the microwave antenna may be about 1000 ohm, the input impedance of the dc power supply about 200 ohm and the impedance of the PIN limiter diode above 1000 ohm for small levels of the RF antenna signal. With increasing level of the RF antenna signal the impedance of the PIN limiter diode may gradually decrease to reach a value of about 50 ohm or even smaller for large levels of the RF antenna signal. Hence, the impedance matching between the microwave antenna and the RF power limiter is gradually deteriorating with increasing level of the RF antenna signal. Consequently, as the level of the RF antenna signal increases an increasing portion of the RF antenna signal is reflected back to the microwave antenna and emitted therefrom. Hence, shielding the components of the dc power supply circuit against excessive RF voltage levels and power levels which could lead to the previously discussed overvoltage and/or overheating problems for large levels of the RF antenna signal.

FIG. 4B) shows a simplified electrical circuit diagram of a second exemplary RF power limiter 104, 204, 304 and DC power supply circuit 106, 206, 306 suitable for use in any of the above discussed second, third and fourth embodiments of the present microwave powered sensor assembly. The RF power limiter comprises a controllable MOSFET transistor $M_1$. The controllable MOSFET $M_1$ is coupled from the RF antenna signal to ground of the RF power limiter and presents a variable shunt impedance to the microwave antenna where the impedance varies in accordance with the level of the incoming RF antenna signal. However, while the impedance characteristics and signal limiting characteristics of the PIN limiter diode is fixed by the intrinsic parameters of the PIN diode itself, the signal limiting characteristics of the MOSFET $M_1$ can be accurately controlled by the digital processor 214, 314 by controlling or adjusting a gate voltage of the gate/control terminal 305 of $M_1$. This feature provides considerable flexibility in the selection or adaptation of the impedance characteristics, and thereby signal limiting characteristics, of the present embodiment of the RF power limiter. The digital processor 214, 314 may for example monitor the level of dc power supply voltage $V_{DD}$ via a suitable input port. The digital processor may be configured to abruptly or gradually decrease the impedance of $M_1$ via adjustment of the gate voltage of $M_1$ when the dc power supply voltage $V_{DD}$ meets a certain criterion for example reaches a predefined threshold level. The latter may indicate a nominal DC voltage of the supply or indicate a fully charged state of the DC power supply circuit 106, 206, 306 such that the amount of incoming power from the RF antenna signal could advantageously be lowered to avoid the previously discussed potentially harmful overvoltage conditions in the dc power supply circuit. The digital processor may control the impedance of $M_1$ such that it remains substantially constant below the predefined threshold level and decreases to a smaller impedance above the threshold level. The smaller impedance of $M_1$ above the predefined threshold level may either be substantially constant or variable such that the impedance gradually decreases with increasing dc power supply voltage.

Figure 5:
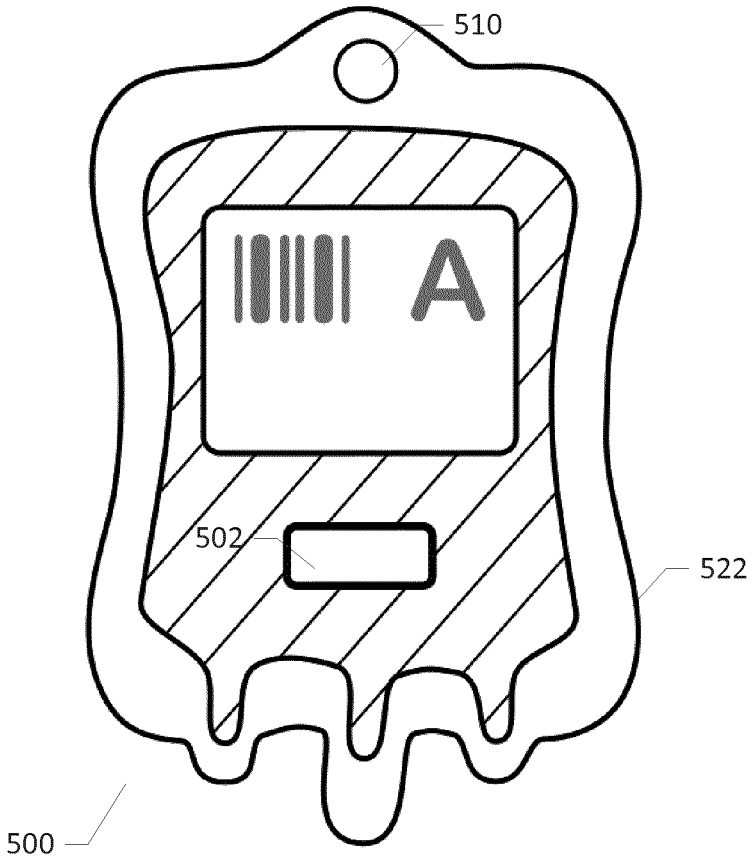
FIG. 5 shows an exemplary medical preparation container in the form of an intravenous infusion fluid bag.

FIG. 5 shows an exemplary medical preparation container in the form of an intravenous infusion fluid bag 500 which may contain various types of medical preparations in liquid or solid frozen form. The medical preparation typically includes a pharmaceutical composition or active agents. The intravenous infusion fluid bag 500 may comprise an integrated microwave powered sensor assembly 105, 205, 305 in accordance with any of the above described embodiments thereof as discussed in additional detail below. The intravenous infusion fluid bag 500 may be designed for use in consumer type of microwave ovens using 2.45 GHz microwave radiation. The intravenous infusion fluid bag 500 may contain a predesignated area 502 for post-manufacturing attachment of the microwave powered sensor assembly 105, 205, 305.

The intravenous infusion fluid bag 500 may comprise an eye or hole to affix the bag to a mating structure of a pole. The intravenous infusion fluid bag 500 furthermore comprises a liquid flow channel (not shown) for delivery of the liquid medical preparation to an IV line or tubing. The intravenous infusion fluid bag 500 (IV bag) may be manufactured in plastics, silicone, rubber or similar elastomeric materials.

Figure 6:
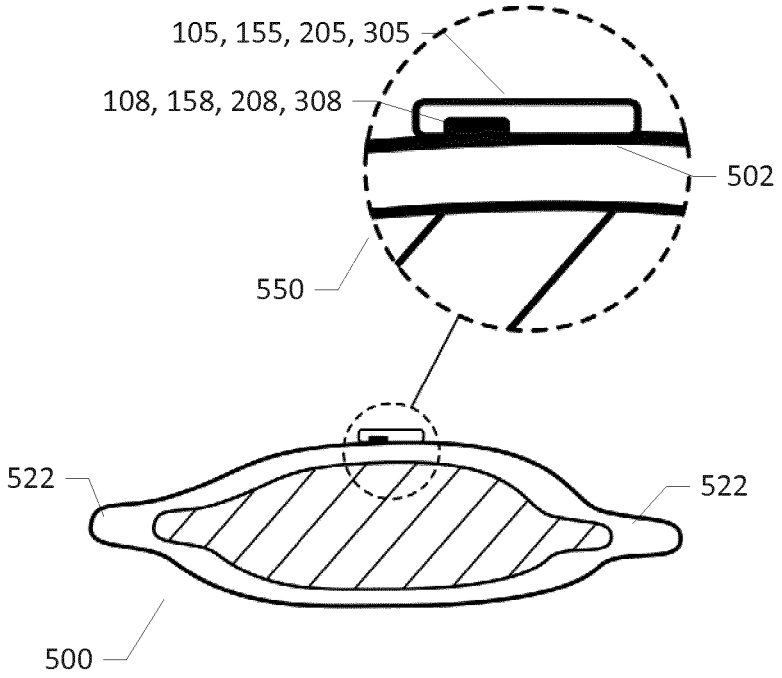
FIG. 6 shows an intravenous infusion fluid bag comprising a microwave powered sensor assembly in accordance with various embodiments of the invention.

FIG. 6 shows a cross-sectional view of the previously discussed intravenous infusion fluid bag 500 together with an enlarged cross-sectional view 550 of a wall area to which the microwave powered sensor assembly 105, 155, 205, 305 is attached. In the present embodiment, the microwave powered sensor assembly is releasably attached to an outer surface of the predesignated area 502 for example by a gluing agent or an elastomeric band etc. This attachment mechanism supports reuse of the microwave powered sensor assembly where the microwave powered sensor assembly is dismantled after the intravenous infusion fluid bag 500 has been heated and disposed of. This reduces the long-term costs associated with the use of intravenous infusion fluid bags in accordance with the present invention.

The sensor 108, 158, 208, 308 of the microwave powered sensor assembly may be brought into physical contact with the outer surface of the predesignated area 502 of the wall of the container—for example to reduce the thermal resistance between the medical preparation and the sensor.

The microwave powered sensor assembly 105, 155, 205, 305 may comprise a relatively short monopole microwave antenna (not shown). The tuning frequency of the monopole microwave antenna may be somewhat higher than the expected 2.45 GHz radiation frequency of the microwave radiation emitted by the microwave oven. Hence, the monopole microwave antenna 502 is deliberately detuned which offers several advantages. A higher tuning frequency of the monopole microwave antenna relative to at tuning at the 2.45 GHz microwave radiation frequency leads to smaller physical dimensions. The smaller physical dimensions leads to smaller dimensions of the microwave powered sensor assembly and simper integration into the various kinds of equipment such as the present intravenous infusion fluid bag 500. The detuning also decreases the amount of microwave energy picked-up by the monopole microwave antenna and therefore decreases the level of the RF antenna signal level applied to either the RF power limiter (if present) and to the DC power supply circuit. The tuning frequency of the monopole microwave antenna relative to at tuning at the 2.45 GHz microwave radiation frequency may be at least 50% higher leading to a turning frequency of the monopole microwave antenna 502 at or above 3.675 GHz. The microwave powered sensor assembly may further comprise a wireless data transmitter (not shown) for example an optical data transmitter as discussed above. The wireless data transmitter is configured to emit a wireless electromagnetic data signal comprising repeatedly measured temperature values of the liquid medical preparation held in the bag 500 as produced by the temperature sensor 526 during heating of the liquid medical preparation to in the microwave oven. If an optical data transmitter is used, the generated optical data signal may be infrared and possess a sufficiently large level or power to penetrate the oven door to reach an optical receiver placed outside the oven chamber as discussed above. The skilled person will understand that the optical data transmitter may be replaced by, or supplemented by, a display such as the display 312 discussed above. The display may indicate the measured temperature values of the liquid medical preparation or simply indicate that a certain preprogramed target temperature of the the the liquid medical preparation is reached to the exterior of the oven chamber. The user may monitor the current temperature of the the liquid medical preparation by reading temperature indications on the display during heating and manually interrupt the microwave oven when the target or desired temperature is reached. In the alternative, the previously discussed microprocessor of the microwave oven may be configured to automatically interrupt the heating of the microwave oven when the desired temperature is reached. This requires that the optical data signal transmitted by the microwave powered sensor assembly is coupled to the microprocessor of the microwave oven via the photodetector. The photodetector may be mounted on the exterior of the oven door or alternatively positioned within the microwave oven for example viewing into the oven chamber through an aperture or shielding mesh.

Figure 7:
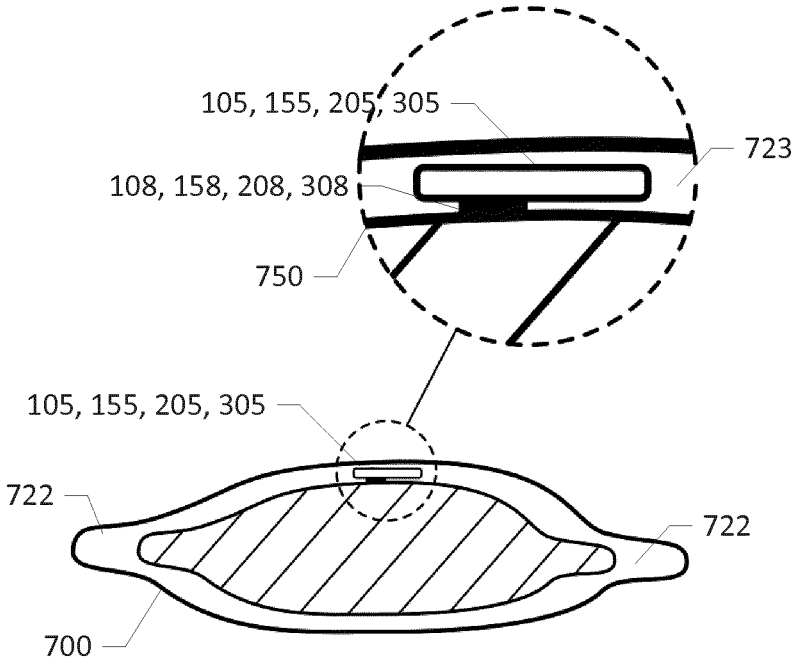
FIG. 7 shows an intravenous infusion fluid bag comprising a microwave powered sensor assembly in accordance with various alternative embodiments of the invention.

FIG. 7 shows a cross-sectional view of an alternative embodiment of the previously discussed intravenous infusion fluid bag 700 together with an enlarged cross-sectional view 750 of a wall area into which the microwave powered sensor assembly 105, 155, 205, 305 is integrated. In the present embodiment, the microwave powered sensor assembly 105, 155, 205, 305 is completely embedded within the bag wall 723. This may be accomplished by various types of manufacturing techniques such as injection molding, overmolding, welding etc.

What is claimed is:

1. A medical preparation container comprising:

material to hold a medical preparation for heating in a microwave oven; and a microwave powered sensor assembly comprising:

a microwave antenna configured to receive microwave radiation within the microwave oven during heating of the medical preparation, the microwave antenna having a predetermined tuning frequency to generate a radio frequency (RF) antenna signal in response to the microwave radiation at a predetermined excitation frequency, wherein the microwave antenna is powered by the microwave radiation without an external power source outside the microwave oven;

a direct current (dc) power supply circuit coupled to the microwave antenna and configured to receive the RF antenna signal and produce a power supply voltage by rectifying and extracting energy from the RF antenna signal; and a sensor connected to the power supply voltage and configured to measure and output a physical property or a chemical property of the medical preparation held in the medical preparation container during heating of the medical preparation, wherein the microwave powered sensor assembly is attached to a wall of the material to hold the medical preparation or partially or fully embedded into the wall of the material to hold the medical preparation, wherein the medical preparation container is to operate enclosed within a microwave oven without an external power source outside the microwave oven.

2. The medical preparation container of claim 1, wherein the microwave powered sensor assembly further comprises:

an RF power limiter coupled between the microwave antenna and the dc power supply circuit to limit an amplitude or power of the RF antenna signal in accordance with predetermined signal limiting characteristics.

3. The medical preparation container of claim 2, wherein the RF power limiter of the microwave powered sensor assembly comprises:

a variable impedance circuit coupled to the microwave antenna, wherein the variable impedance circuit exhibits an input impedance that decreases with increasing amplitude or power of the RF antenna signal at the predetermined excitation frequency to decrease a matching between the input impedance of the RF power limiter and an impedance of the microwave antenna.

4. The medical preparation container of claim 1, wherein the predetermined tuning frequency of the microwave antenna deviates from the predetermined excitation frequency of the microwave radiation by more than +50% or more than −33%.

5. The medical preparation container of claim 4, wherein the predetermined tuning frequency of the microwave antenna is at least 50% higher than the predetermined excitation frequency of the microwave radiation.

6. The medical preparation container of claim 1, wherein the microwave antenna comprises at least one of: a monopole antenna, a dipole antenna, or a patch antenna.

7. The medical preparation container of claim 1, comprising at least one of: a medical fluid bag, an agar container, or a syringe.

8. The medical preparation container of claim 1, wherein the sensor of the microwave powered sensor assembly is arranged to obtain physical contact or sensory contact with the medical preparation.

9. The medical preparation container of claim 1, wherein the microwave powered sensor assembly is partially or fully embedded in a wall section, a lid section, or a bottom section of the wall of the material of the medical preparation container.

10. The medical preparation container of claim 1, wherein the microwave powered sensor assembly is detachably fastened to a wall section, a lid section, or a bottom section of the wall of the material of the medical preparation container.

11. The medical preparation container of claim 1, wherein the microwave powered sensor assembly comprises:

an electrically conductive housing configured to enclose and shield at least the dc power supply circuit against the microwave radiation.

12. The medical preparation container of claim 1, wherein the microwave powered sensor assembly further comprises:

a digital processor coupled to the power supply voltage for receipt of operating power; and a wireless data transmitter to transmit, to an exterior of an oven chamber of the microwave oven, parameter values of the physical property or the chemical property of the medical preparation during heating of the medical preparation.

13. The medical preparation container of claim 12, wherein the microwave powered sensor assembly further comprises:

a data memory to store a target temperature profile for heating of the medical preparation, the digital processor being configured to read the target temperature profile from the data memory and transmit the target temperature profile via the wireless data transmitter to the exterior of the oven chamber during heating of the medical preparation.

14. A method of monitoring a physical property or a chemical property of a medical preparation during heating, the method comprising:

a) positioning a medical preparation container, holding a medical preparation inside an oven chamber of a microwave oven, wherein the medical preparation container comprises material to hold the medical preparation for heating in the microwave oven and a microwave powered sensor assembly comprising a sensor, wherein the microwave powered sensor assembly is attached to a wall of the material or partially or fully embedded into the wall of the material;

b) activating the microwave oven to produce electromagnetic radiation within the oven chamber thereby irradiating and heating the medical preparation;

c) extracting energy from a radio frequency (RF) antenna signal in response to irradiation of the microwave powered sensor assembly by the electromagnetic radiation such that the microwave powered sensor assembly is powered by the electromagnetic radiation without an external power source outside the oven chamber of the microwave oven; and d) repeatedly measuring a physical property or a chemical property of the medical preparation by the sensor that is powered by the energy extracted from the RF antenna signal.

15. The method of claim 14, further comprising at least one of:

displaying a parameter value of the physical property or the chemical property of the medical preparation; or transmitting a parameter value of the physical property or the chemical property of the medical preparation to a wireless receiver arranged outside the oven chamber via a wireless data communication link.

16. The medical preparation container of claim 1, wherein the microwave powered sensor assembly comprises a display to display a parameter value the physical property or the chemical property of the medical preparation during heating of the medical preparation.

* * * * *